US010206443B2

(12) United States Patent
Tarrell

(10) Patent No.: US 10,206,443 B2
(45) Date of Patent: Feb. 19, 2019

(54) CAMOUFLAGE MATERIAL AND METHOD OF MAKING AND USING SAME

(71) Applicant: Cabela's LLC, Sidney, NE (US)

(72) Inventor: Ev Tarrell, Sidney, NE (US)

(73) Assignee: Cabela's LLC, Sidney, NE (US)

( * ) Notice: Subject to any disclaimer, the term of this patent is extended or adjusted under 35 U.S.C. 154(b) by 379 days.

(21) Appl. No.: 14/189,931

(22) Filed: Feb. 25, 2014

(65) Prior Publication Data

US 2014/0242358 A1 Aug. 28, 2014

Related U.S. Application Data

(60) Provisional application No. 61/769,631, filed on Feb. 26, 2013.

(51) Int. Cl.

| | |
|---|---|
| ***A41D 31/00*** | (2006.01) |
| ***A41H 3/08*** | (2006.01) |
| *A41D 13/02* | (2006.01) |

(52) U.S. Cl.

CPC ..... *A41D 31/0011* (2013.01); *A41H 3/08* (2013.01); *A41D 13/02* (2013.01); *Y10T 428/2481* (2015.01)

(58) Field of Classification Search

USPC ..... 428/196

See application file for complete search history.

(56) References Cited

U.S. PATENT DOCUMENTS 6,811,835 B1 * 11/2004 Parietti ..... A41D 31/0011 428/15

2005/0005339 A1 * 1/2005 Johnson ..... A41D 13/00 2/69

* cited by examiner

*Primary Examiner* — Lynda Salvatore

(74) *Attorney, Agent, or Firm* — Pillsbury Winthrop Shaw Pittman LLP

(57) ABSTRACT

A camouflage system includes a camouflage surface having a plurality of segments. The camouflage surface includes a first pattern disposed on a first segment of the plurality of segments, the first pattern including a depiction of a first microterrain of a natural environment, a second pattern disposed on a second segment of the plurality of segments, the second pattern including a depiction of a second microterrain of the natural environment, and a third pattern disposed on a third segment of the plurality of segments, the third pattern including a depiction of a third microterrain of the natural environment. The first microterrain differs from the second microterrain and the second microterrain differs from the third microterrain.

5 Claims, 15 Drawing Sheets

CAMOUFLAGE MATERIAL AND METHOD OF MAKING AND USING SAME

CROSS-REFERENCE TO RELATED APPLICATIONS

This application claims priority U.S. Provisional Patent Application 61/769,631, filed on Feb. 26, 2013.

TECHNICAL FIELD

The disclosure relates in general to camouflage patterns and methods of making the same, and more particularly to camouflage patterns having multiple microterrain pattern zones.

BACKGROUND ART

Camouflage techniques are used to obscure objects for the purpose of decreasing or preventing detection. One camouflage technique involves constructing objects having certain surface patterns. These patterns are designed to blend into the environment and conceal the object from visual detection.

Camouflage patterns were initially developed for military applications in WWI to conceal troops and equipment from detection by enemy forces. Eventually, the use of camouflage spread to civilian use as hunters recognized the benefits of camouflage to conceal themselves and their equipment from wildlife. Other outdoor enthusiasts, such as paint ball players, bird watchers, and other nature enthusiasts also commonly use camouflage.

Initially, camouflage patterns used by hunters were similar to the early military patterns of randomly arranged colored splotches. Later, as printing and photography techniques improved, camouflage patterns were developed that incorporated the colors and imagery of a particular environment. As a result, camouflage patterns moved from simple patterns having only a handful of color variations, generally green, brown, or grey, to a wide assortment of patterns targeted to a particular environment and even to a particular season. For example, a camouflage pattern designed for a timber forest in the fall season may contain elements having brown, orange, and yellow. In contrast, a camouflage pattern designed for a timber forest in the winter season may contain elements having brown and white.

Many modern camouflage patterns include photorealistic images of a particular environment. These patterns generally contain high quality images of a single perspective of the vegetation and/or background flora and fauna. These patterns are most effective in concealing a hunter when the perspective displayed in the pattern matches the perspective in the surrounding environment (i.e., the background and/or foreground).

For example, a photorealistic pattern including reed stalks is most effective when the hunter is standing amongst reed stalks. These patterns, however, lose their effectiveness when the hunter moves to a nearby location having a different type of vegetation in which reed stalks are not prevalent. In that situation, the reed stalk pattern causes the hunter to stand-out, rather than blend into his or her surroundings.

Accordingly, patterns that mimic a specific environment with high detail, as do many photorealistic patterns, are inherently less suited to other environments or even to different areas within a target environment.

Accordingly, it would be an advance in the state of the art to provide a camouflage pattern for outdoor garments and hunting equipment that is highly effective in obscuring an individual across a range of microterrains within a larger target environment.

SUMMARY OF THE INVENTION

In one embodiment, a camouflage system includes a camouflage surface having a plurality of segments. The camouflage surface includes a first pattern disposed on a first segment of the plurality of segments, the first pattern comprising a depiction of a first microterrain of a natural environment, a second pattern disposed on a second segment of the plurality of segments, the second pattern comprising a depiction of a second microterrain of the natural environment, and a third pattern disposed on a third segment of the plurality of segments, the third pattern comprising a depiction of a third microterrain of the natural environment. The first microterrain differs from the second microterrain and the second microterrain differs from the third microterrain.

In another embodiment, a camouflage system including a surface including a first pattern disposed on a first portion of the surface. The first pattern includes a depiction of a first position of a first microterrain of a natural environment. The surface includes a second pattern disposed on a second portion of the surface. The second pattern includes a depiction of at least one of the first microterrain and a second microterrain of the natural environment.

In another embodiment, a method of creating a camouflage fabric is presented. The method comprises applying to a fabric a first microterrain pattern extending in a first direction along the fabric, a second microterrain pattern extending in the first direction along the fabric, a third microterrain pattern extending in the first direction along the fabric, a first transition region between the first microterrain pattern and the second microterrain pattern, and a second transition region between the second microterrain pattern and the third microterrain pattern. The method includes cutting a plurality of segments from the fabric, wherein the plurality of segments are randomly selected to include at least a portion of each of the first microterrain pattern, the second microterrain pattern, and the third microterrain pattern, and joining at least two of the plurality of segments.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

The invention is described in preferred embodiments in the following description with reference to the Figures, in which like numerals represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
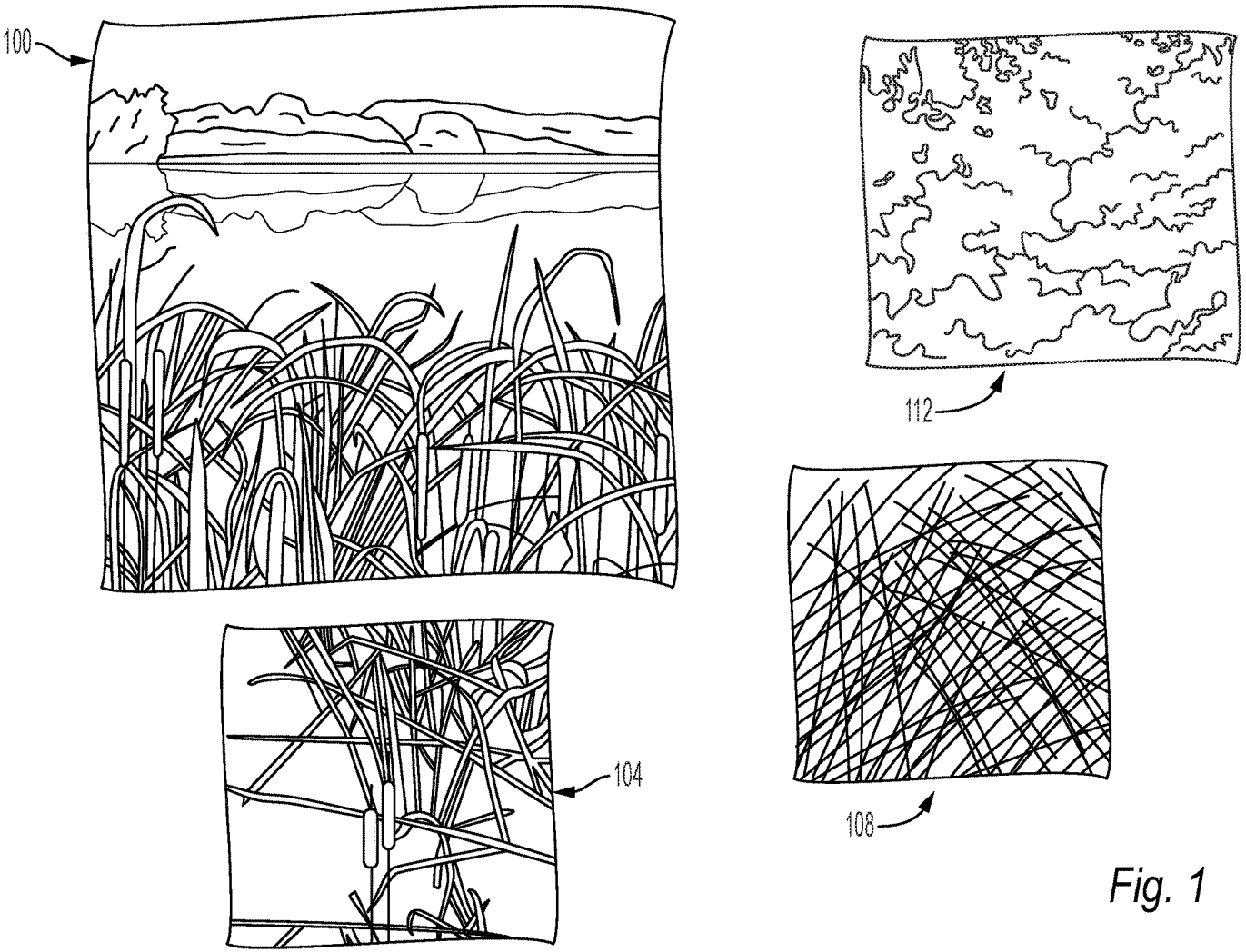
FIG. 1 is an illustration identifying three perspective zones in a wetland environment.

Referring to FIG. 1, an example landscape or target environment 100, in this case depicting wetlands, is presented. Although a particular landscape or target environment may only cover a small geographical region, the target environment may include a number of different visual scenes, referred to herein as microterrains, that each include a relatively wide variety of vegetation or visual scenes. For example, wetland 100 includes, within relatively near proximity to one another, areas that are predominated by cattails and/or reeds nearby a lake, stream, or other body of water 104, grasses 108, and fencerows of vegetation 112, each representing a different visual scene within the target environment. If a hunter, wearing camouflage depicting a single one of those microterrains, (e.g., cattails) moves a small distance into a region of a different microterrain, that plant-specific camouflage will no longer be effective.

Within a particular target environment, a camouflage pattern mimicking any one of images 104, 108, or 112 will be highly effective at obscuring an object when viewed in a microterrain having the vegetation depicted in the image 104, 108, or 112, respectively. However, when viewed in a different region of the landscape (that is, within a different microterrain), having different vegetation, such as when camouflage depicting the cattails of image 104 is worn in a region having a microterrain predominated by the grasses of image 108, or the vegetation of image 112, the obscuring capability of the camouflage is severely reduced or, in extreme cases, completely eliminated. In some scenarios, such a mismatch in appearance, even between microterrains of a particular target environment, will cause the camouflage to highlight, as opposed to obscure, an object.

This can be particularly problematic as a hunter, or other individual wearing camouflage, is very likely to move about within a particular area. If the camouflage is narrowly suited to only a single microterrain of the area, as the individual moves about the area, potentially passing through a number of other microterrains, the camouflage's effectiveness will be severely reduced when the camouflage is present within those other microterrains.

Nearly every possible terrain in which camouflage may be utilized incorporates a number of different microterrains. In a city, for example, where law enforcement or the military may require camouflage, microterrains may include those predominated by buildings, vehicles, or park foliage. In a general hunting environment, different microterrains may be predominated by conifer trees, hardwood trees, grass, and water, for example. When utilizing camouflage within a particular target environment, it is generally always possible to identify a number of different microterrains that each have an overall appearance that are markedly different from one another. The difference in appearance between microterrains can make the design of camouflage difficult, as the camouflage must perform equally well in all microterrains. Camouflage that is only satisfactory for a single microterrain may become entirely inoperable when the camouflage is positioned in a different microterrain that may be only feet away.

Without limitation, a microterrain may include a common type of environment identified within a particular target area, such as a sage or sagebrush environment, a grass or grassy plain environment, a leaf environment, a woodlands environment, a brush environment, a rock environment, a pine environment, a marsh environment, or a desert or desert plain environment. The visual attributes of a particular microterrain of a target environment may also be affected by a season in which the microterrain may be depicted. For example, a microterrain of a "fall season" woodlands environment depiction may contain leaves, for example, having brown, orange, red and other fall colors; a microterrain of a "winter season" woodlands environment may contain, for example, bare trees with no leaves and white snow; and a microterrain of a "summer season" woodlands environment may contain, for example, green leaves with little or no twigs or bark. Additionally, the visual attributes of a given environment may vary even within a particular microterrain. For example, within a particular woodland microterrain containing, for example, particular types of trees, different visual attributes may be present when viewing the microterrain from different positions, such as a height of 6 feet (wherein the visual attributes would be predominated by tree trunk structures), a height of 14 feet (wherein the visual attributes would be predominated by tree limbs and thicker branches), and a height of 22 feet (wherein the visual attributes would be predominated by thin branches and leaves). Similarly, a micro terrain including corn stalks may have different visual attributes, such as disc corn, stubble corn, and/or standing corn. Accordingly, it is explicitly contemplated in the present disclosure that different positions within a microterrain (referred to herein as micropositions), though occupying the same approximate location and belonging to the same microterrain, may have different visual attributes and that those different visual attributes may be utilized in generating a camouflage pattern in accordance with the present disclosures. In various implementations, a single camouflage pattern configured in accordance with the present disclosure may depict a number of different micropositions within the same microterrains. Alternatively, a camouflage pattern may be generated depicting a number of micropositions selected from a number of different microterrains.

The present system and method, therefore, provides for the creation of camouflage that incorporates elements from a plurality of microterrains (and, potentially, micropositions of those microterrains) of a particular target geographical region. By depicting a number of microterrains and micropositions, the resulting camouflage can be utilized to provide an obscuring function in a number of different microterrains that are likely to be present within the target geographical region. In one implementation of the present system, various zones of a camouflage pattern may predominantly depict elements from a particular microterrain, as described below. In some cases, to facilitate blending between the different zones of the camouflage pattern, a zone that is targeted towards depicting elements from a first microterrain, may depict a small number of elements from other microterrains. This blending can serve to soften the borders between the different regions of the fabric where the different microterrain elements are depicted.

The present camouflage system can be utilized to generate camouflage patterns that may be utilized in conjunction with any clothing, equipment, or object to which the camouflage pattern is to be applied. In the present disclosure, a number of examples describe the present system in terms of camouflage clothing. However, it is to be understood that the present camouflage system may be utilized to camouflage non-clothing objects, such as weapons, hunting equipment, camping equipment, footwear, and the like.

Figure 2:
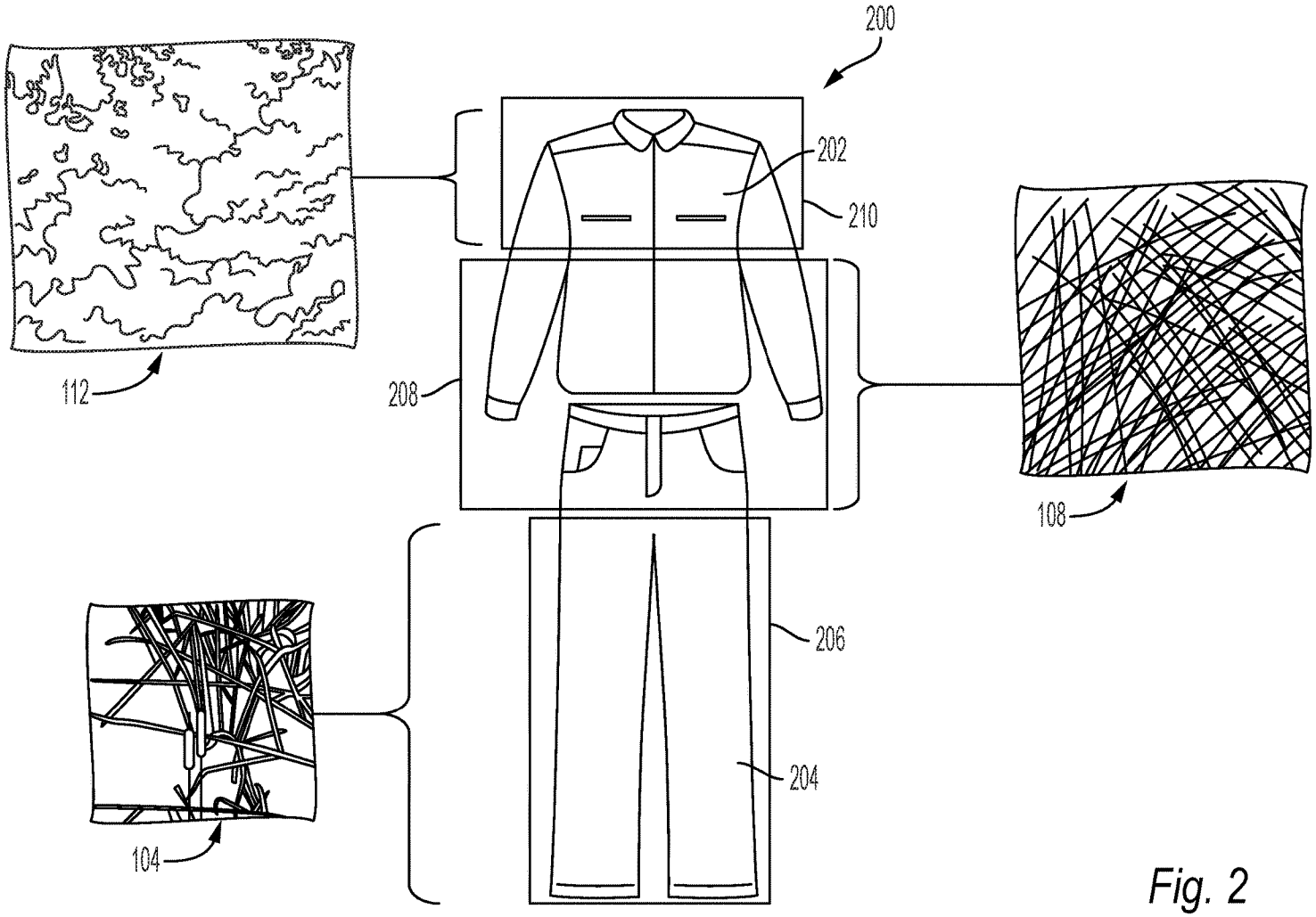
FIG. 2 is an exemplary embodiment of a clothing set with three camouflage zones mimicking microterrains of a wetland environment.

Referring to FIG. 2, one embodiment of a clothing set 200 with three camouflage zones is depicted. The clothing set 200 includes a jacket 202 and a pair of pants 204. In one embodiment, the jacket 202 and pair of pants 204 are separate and distinct garments. In one embodiment, the jacket 202 includes an integrated hood (not shown) for covering the back, top, and sides of the head. In one embodiment, the jacket 202 and pair of pants 204 are integrated into a single garment.

In the example depicted in FIG. 2, the lower portion of the pants 204 is configured with a pattern that mimics the first microterrain of image 104. The area of the pants 204 configured with the first microterrain is identified by zone 206. The upper portion of the pants 204 and the lower portion of the jacket 202 are configured with a pattern that mimics the second microterrain of image 108. The area of the pants 204 and jacket 202 configured with the second microterrain perspective pattern is identified by zone 208. The upper portion of the jacket 202 is configured with a pattern that mimics the third microterrain perspective of image 112. The area of the jacket 202 configured with the third microterrain perspective pattern is identified by zone 210.

The arrangement of the camouflage patterns 104, 108, and 112 on the clothing set 200 each operate to obscure a different portion of the clothing set, depending upon the microterrain in which the hunter is present. When worn by a hunter standing in or near a microterrain predominated by cattails and reeds, for example, the zone 206 configured with the first pattern 104 effectively obscures the hunter's feet and lower legs. Likewise, the zone 208 configured with the second pattern 108 effectively obscures that portion of the hunter when the hunter stand in a microterrain predominated by grasses. Finally, the zone 210 configured with the third microterrain pattern 112 effectively obscures that portion of the hunter when the hunter stands in a microterrain predominated by that type of vegetation. It should be noted that, with respect to the garment depicted in FIG. 2, although the garment is shown as having different microterrains on different distinct regions of the garment (e.g., a first microterrain pattern is allocated to an arm, while a second microterrain pattern is allocated to a leg), in various implementations the distribution of microterrain patterns (and, in fact, microposition patterns) on the garment may be substantially random, in which the distribution of patterns 104, 108, and 112 are randomly dispersed about the surface of the garment.

Unlike prior art camouflage, which is generally consistent from head to toe, the present camouflage comprises multiple zones, each zone being tailored to specific types of microterrains that may be encountered by a hunter on a particular trip or series of outings, where the series of trips may lead the hunter to multiple microterrains in multiple seasons, for example. The zones are selected and configured to provide enhanced obscuring performance when in the field. In certain embodiments, the zones are distinguished from one another by the types of vegetation predominantly displayed within the zone, where the vegetation is associated with a particular microterrain (or microposition) of a target geographic region.

When in the field, hunters are generally visible from a variety of different locations because they move across different areas and assume different positions, such as crouching, kneeling, sitting, and standing, in one trip, or from trip to trip. While traditional camouflage will effectively obscure a hunter primarily in one location (and presuming that the hunter's camouflage is matched to that location), the clothing set 200 is, in one embodiment, designed to effectively obscure at least one portion of the hunter at all times in a number of microterrains within a larger target environment (e.g., a wetlands environment). This results in at least a portion of the body being hidden from view and, thereby, the breaking up and obscuring of the hunter's human form. In different scenarios, depending on the background and foreground perspectives, only one of zones 206, 208, and 210 may be fully obscured. While only a portion of the hunter is obscured, the shape of the human body is broken up and hidden. By hiding the human form, the present camouflage hides the pattern that alerts animals.

In the embodiment shown in FIG. 2, the zones 206, 208, and 210 are each predominantly directed to particular microterrains in a larger environment (e.g., wetlands). In other embodiments, zones 206, 208, and 210 are of a woodland environment, western plains environment, desert environment, or any other hunting environment that includes multiple microterrains.

Figure 3:
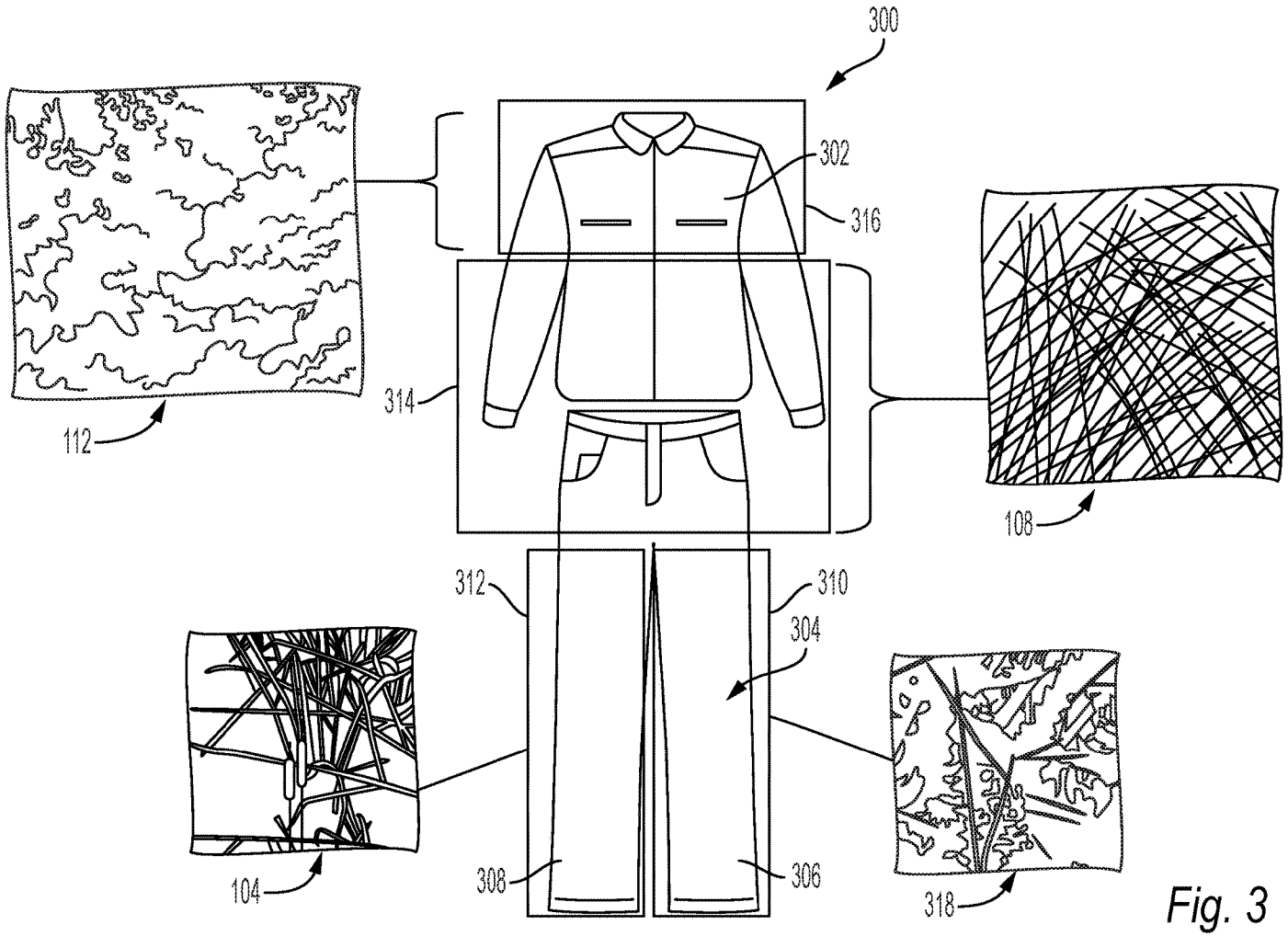
FIG. 3 is an exemplary embodiment of a clothing set with three camouflage zones for mimicking microterrains of a wetland environment and one camouflage zone for mimicking a microterrain of a woodland environment.

Referring to FIG. 3, an embodiment of a clothing set 300 with four camouflage zones depicting microterrains across two different target environments is depicted. The clothing set 300 includes a jacket 302 and a pair of pants 304. The pair of pants 304 includes a left leg 306 and a right leg 308. The left leg 306 is configured with a pattern that mimics a woodland microterrain of image 318. The area of the left leg 306 configured with the pattern is identified by zone 310. The right leg 308 is configured with a pattern that mimics the microterrain of image 104. The area of the right leg 308 that mimics the microterrain of image 104 is identified by zone 312. The upper portion of the pants 304 and the lower portion of the jacket 302 are configured with a pattern that mimics the microterrain of image 108. The area of the pants 304 and jacket 302 that mimics the microterrain of image 108 is identified by zone 314. The upper portion of the jacket 302 is configured with a pattern that mimics the microterrain of image 112. The area of the jacket 302 that mimics the microterrain of image 112 is identified by zone 316. It should be noted that, with respect to the garment depicted in FIG. 3, although the garment is shown as having different microterrains on different distinct regions of the garment (e.g., a first microterrain pattern is allocated to an arm, while a second microterrain pattern is allocated to a leg), in various implementations the distribution of microterrain patterns (and, in fact, microposition patterns) on the garment may be substantially random, in which the distribution of patterns 104, 108, 112, and 318 are randomly dispersed about the surface of the garment.

Many wetlands are bordered by woodlands. In addition to the obscuring qualities described with regards to clothing set 200 in FIG. 2, clothing set 300 is additionally capable of effectively obscuring the left leg when positioned in a microterrain predominated by a woodland vegetation. As such, the human form is obscured in a woodland environment even though the majority of the clothing set is adapted for various microterrains of the wetlands environment.

Figure 4:
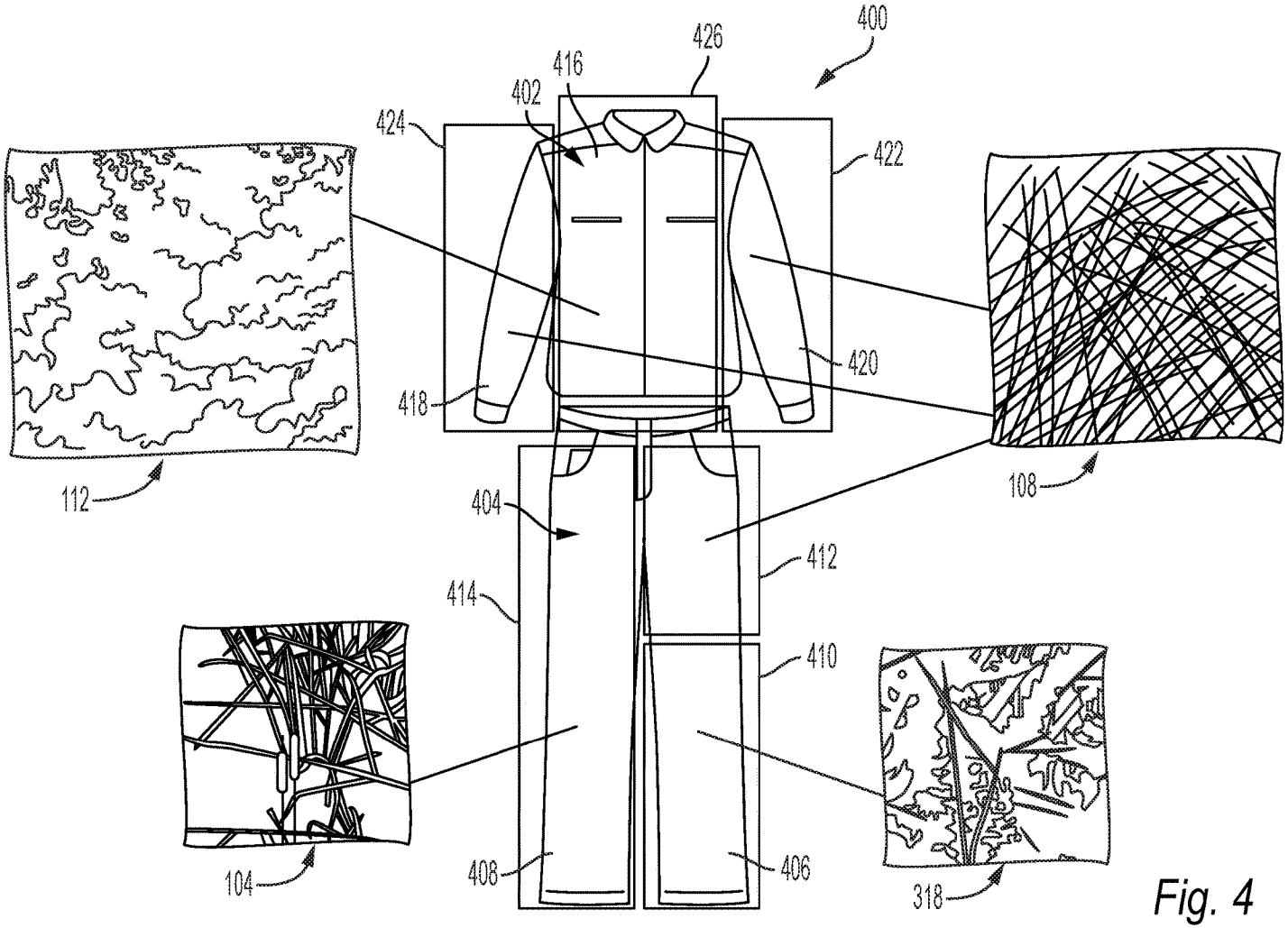
FIG. 4 is an exemplary embodiment of a clothing set with five camouflage zones for mimicking microterrains of a wetland environment and one camouflage zone for mimicking a microterrain of a woodland environment.

Referring to FIG. 4, an embodiment of a clothing set 400 with six camouflage zones depicting microterrains across two different target environments is depicted. The clothing set 400 includes a jacket 402 and a pair of pants 404. The pair of pants 404 includes a left leg 406 and a right leg 408. The lower portion of the left leg 406 is configured with a pattern that mimics the microterrain of image 318. The area of the lower left leg 406 that mimics the microterrain of image 318 is identified by zone 410. The upper portion of the left leg 406 is configured with a pattern that mimics the microterrain of image 108. The area of the upper left leg 406 that mimics the microterrain of image 108 is identified by zone 412. The right leg 408 is configured with a pattern that mimics the microterrain of image 104. The area of the left leg 408 that mimics the microterrain of image 104 is identified by zone 414.

The jacket 402 includes a body 416, a left arm 420, and a right arm 418. The left arm 420 and right arm 418 are configured with a pattern that mimics the microterrain of image 108. The areas of the jacket 402 that mimic the microterrain of image 108 are identified by zones 422 and 424. The body 416 is configured with a pattern that mimics the microterrain of image 112. The area of the jacket 402 that mimics the microterrain of image 112 is identified by zone 426. It should be noted that, with respect to the garment depicted in FIG. 4, although the garment is shown as having different microterrains on different distinct regions of the garment (e.g., a first microterrain pattern is allocated to an arm, while a second microterrain pattern is allocated to a leg), in various implementations the distribution of microterrain patterns (and, in fact, microposition patterns) on the garment may be substantially random, in which the distribution of patterns 104, 108, 112, and 318 are randomly dispersed about the surface of the garment.

Figure 5:
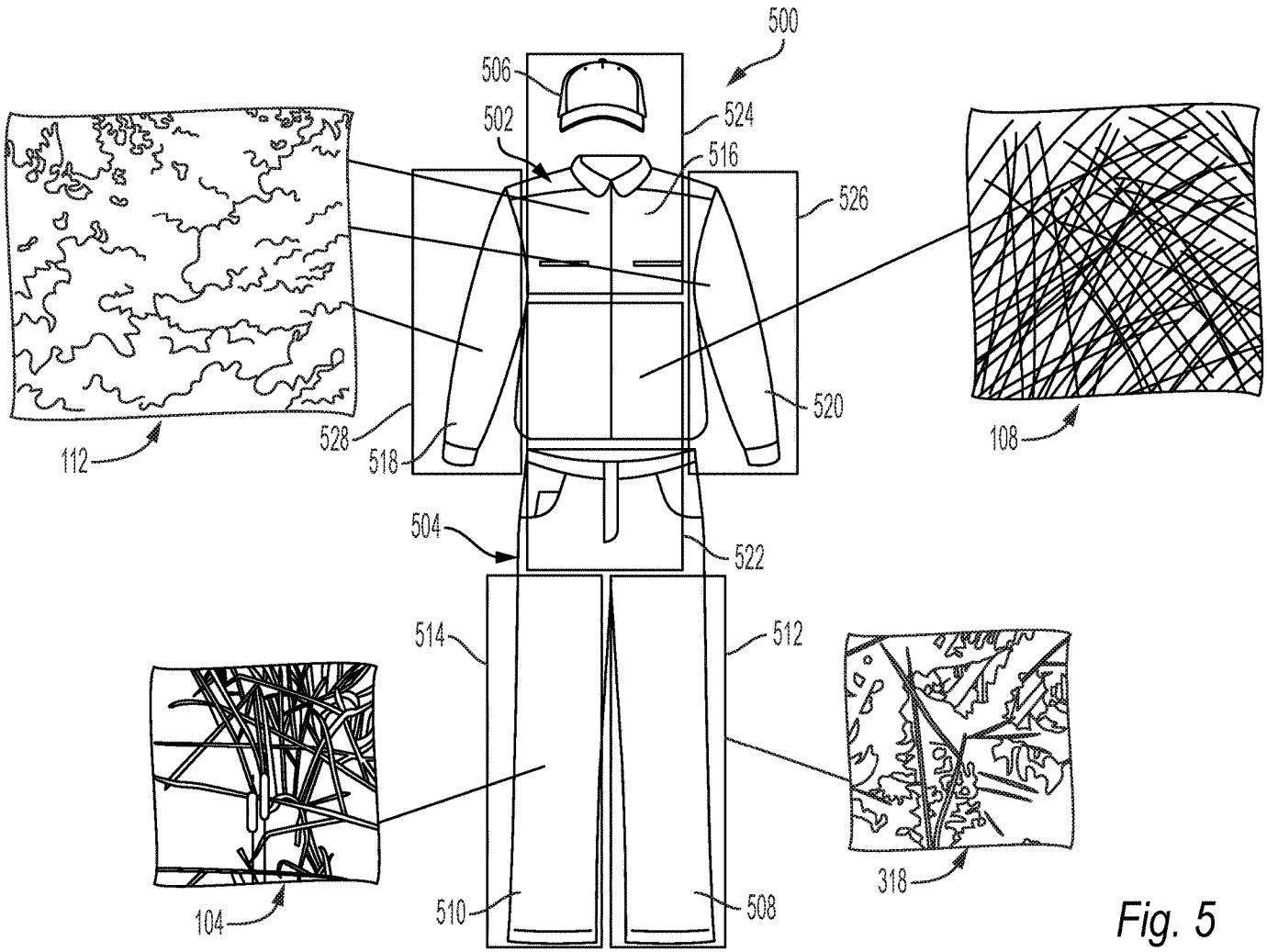
FIG. 5 is another exemplary embodiment of a clothing set with five camouflage zones for mimicking microterrains of a wetland environment and one camouflage zone for mimicking a microterrain of a woodland environment.

Referring to FIG. 5, another embodiment of a clothing set 500 with six camouflage zones depicting microterrains across two different target environments is depicted. The clothing set 500 includes a jacket 502, a pair of pants 504, and a hat 506. The pair of pants 504 includes a left leg 508 and a right leg 510. The left leg 508 is configured with a pattern that mimics the microterrain of image 318. The area of the left leg 508 that mimics the microterrain of image 318 is identified by zone 512. The right leg 510 is configured with a pattern that mimics the microterrain of image 104. The area of the right leg 510 that mimics the microterrain of image 104 is identified by zone 514.

The jacket 502 includes a body 516, a left arm 520, and a right arm 518. The upper portion of the pair of pants 504 and the lower portion of the body 516 is configured with a pattern that mimics the microterrain of image 108. The area of the upper pants 504 and lower body 516 that mimics the microterrain of image 108 is identified by zone 522. The left arm 520, right arm 518, upper body 516, and hat 506 are configured with the pattern that mimics the microterrain of image 112. The area of the jacket 502 and hat 506 that mimics the microterrain of image 112 is identified by zones 524, 526, and 528. It should be noted that, with respect to the garment depicted in FIG. 5, although the garment is shown as having different microterrains on different distinct regions of the garment (e.g., a first microterrain pattern is allocated to an arm, while a second microterrain pattern is allocated to a leg), in various implementations the distribution of microterrain patterns (and, in fact, microposition patterns) on the garment may be substantially random, in which the distribution of patterns 104, 108, 112, and 318 are randomly dispersed about the surface of the garment.

In one embodiment, the jacket and pants of clothing sets 200, 300, 400, and 500 are configured as distinct garments. In another embodiment, the jacket and pants of clothing sets 200, 300, 400, and 500 are configured as a single garment. In one embodiment, the clothing sets 200, 300, 400, and 500 consist of a jacket only. In one embodiment, the clothing sets 200, 300, 400, and 500 consist of a pair of pants only. In one embodiment, the clothing sets 200, 300, 400, and 500 consist of one or more of a jacket, a pair of pants, a hat, a pair of gloves, and a scarf.

In one embodiment, the patterns on clothing sets 200, 300, 400, and 500 that mimic images 104, 108, 112, and 318 can be photorealistic images. In one embodiment, the patterns on clothing sets 200, 300, 400, and 500 that mimic the microterrains of images 104, 108, 112, and 318 can be semi-photorealistic images, such as drawings, sketches, or other artistic renderings designed to replicate, mimic, or intimate the visual attributes of a particular microterrain or microposition within a microterrain. In one embodiment, the patterns on clothing sets 200, 300, 400, and 500 that mimic the microterrains of images 104, 108, 112, and 318 can be a combination of photorealistic images and semi-photorealistic images that may depict a particular scene or a collection of artifacts from a particular microterrain or microposition within a microterrain. As used herein, photorealistic means high resolution, photo quality, lifelike images where details smaller than ¼ inch can be discerned. As used herein, semi-photorealistic means medium resolution images where only features greater than ¼ inch can be discerned. In other implementations, though, non photorealistic or semi-photorealistic images may be utilized. In that case, the patterns, although not depicting specific objects or items, may include patterns and/or shapes that are tailored to mimic elements or scenes from a particular microterrain.

In one embodiment, the patterns on clothing sets 200, 300, 400, and 500 that mimic the microterrain of images 104, 108, 112, and 318 are configured on the clothing set by printing. In various embodiments, the patterns are configured by screen printing, roller printing, air brushing, jet printing, digital printing, block print, or any other suitable printing technologies, or a combination thereof.

In one embodiment, the patterns on clothing sets 200, 300, 400, and 500 that mimic images 104, 108, 112, and 318 are configured on the clothing set by attaching a synthetic layer printed with the pattern to the garment material that forms the clothing set.

In one embodiment, the patterns on clothing sets 200, 300, 400, and 500 that mimic the microterrain of images 104, 108, 112, and 318 are all formed on a single, continuous piece of fabric, cut, and formed into a clothing set. In another embodiment, the different patterns, mimicking the microterrains of images 104, 108, 112, or 318, are each printed on a separate piece of fabric, cut, and combined to form a clothing set.

Figures 6A, 6B, 6C, 6D:
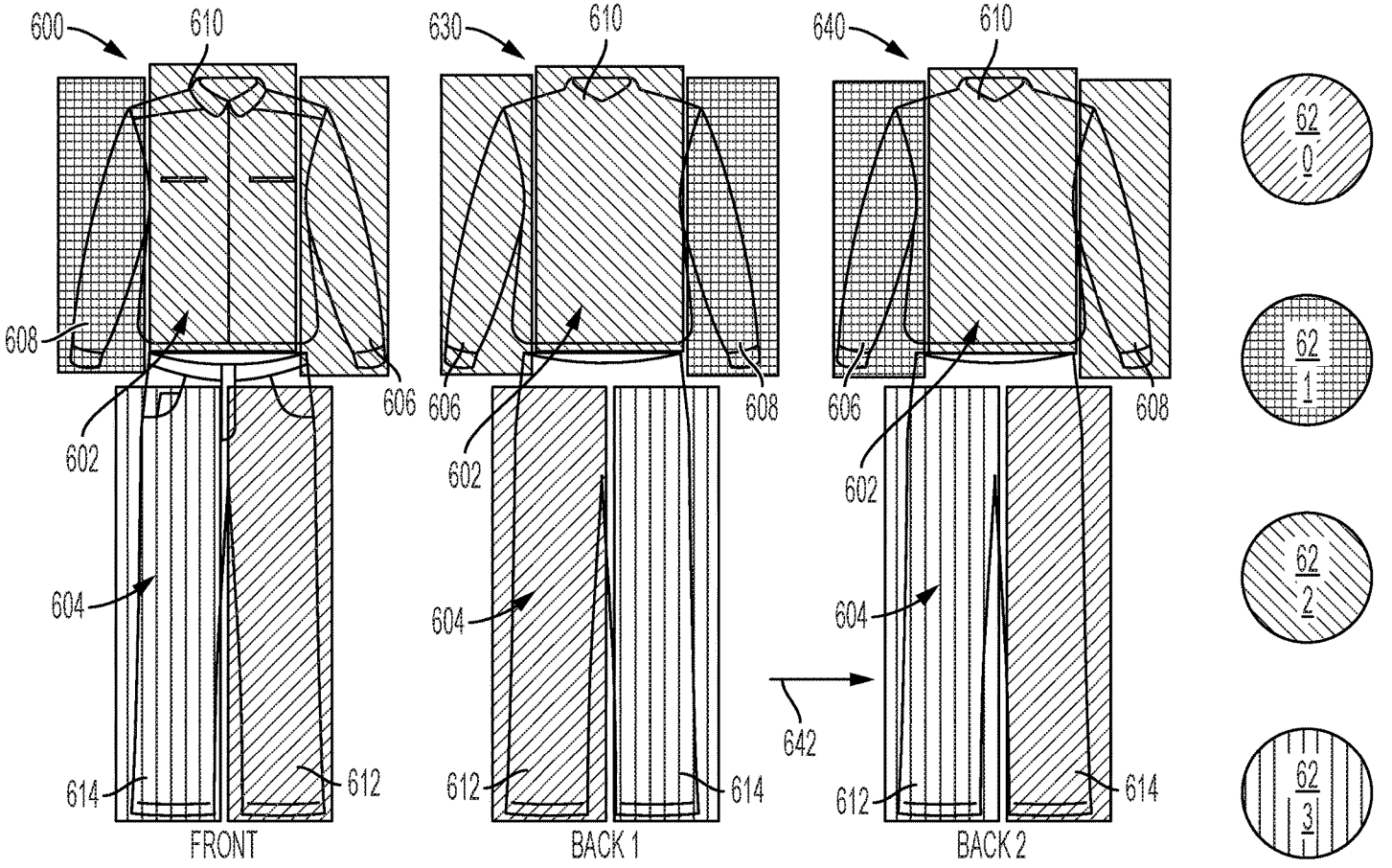
FIGS. 6(*a*)-6(*d*) are drawings showing the arrangement of perspective zones on the front and back of different embodiments of a clothing set.

Referring to FIGS. 6(*a*)-6(*c*), a front configuration and two back configurations for an embodiment of Applicant's camouflage system is depicted. Referring first to FIG. 6(*a*), a front view of a clothing set 600 with five camouflage zones containing elements from different microterrains is depicted. Clothing set 600 includes a jacket 602 and a pair of pants 604. The jacket 602 includes a left arm 606, a right arm 608, and a body 610. The pair of pants 604 includes a left leg 612 and a right leg 614. Referring to FIG. 6(*d*), different zone patterns 620-623 are shown. Each zone pattern 620, 621, 622, and 623 mimic visual elements that predominate different microterrains of a specific environment. Each zone pattern 620, 621, 622, and 623 is unique with respect to the other zone patterns.

Referring back again to FIG. 6(*a*), the left leg 612 is configured with pattern 620, the right leg 614 is configured with pattern 623, the body 610 and left arm 606 are configured with pattern 622, and the right arm 608 is configured with pattern 621.

Referring to FIG. 6(*b*), clothing set 630 depicts one configuration of the rear view of clothing set 600 in FIG. 6(*a*). The left leg 612 is configured with pattern 620, the right leg 614 is configured with pattern 623, the body 610 and left arm 606 are configured with pattern 622, and the right arm 608 is configured with pattern 621. In this configuration, each zone on the back view of the clothing set 630 has the same pattern as the front view of the clothing set 600. As such, when viewed from the side, the pattern will appear to be continuous.

In one embodiment, each pattern if formed from a separate piece of fabric, which are then stitched together to form the clothing set 600/630. In another embodiment, each pattern is formed on a single piece of fabric, which is cut and stitched together to form the clothing set 600/630.

Referring to FIG. 6(*c*), clothing set 640 depicts a second configuration of the rear view of clothing set 600. The left leg 612 is configured with pattern 623, the right leg 614 is configured with pattern 620, the body 610 and right arm 608 are configured with pattern 622, and the left arm 606 is configured with pattern 621.

In this configuration, each portion of the back view of the clothing set 630 has a different pattern as the front view of the clothing set 600. The two patterns will, in one embodiment, meet at a seam midway between the front and back. When viewed from the side, half of the visible portions will be one pattern and half will be the other. As such, even when viewed from the side, a portion of the body will be effectively hidden when viewed against any of four different backgrounds, obscuring the human form from being perceived by nearby animals. It should be noted that, with respect to the garments depicted in FIGS. 6*a*-6*c*, although the garment is shown as having different microterrains on different distinct regions of the garment (e.g., a first microterrain pattern is allocated to an arm, while a second microterrain pattern is allocated to a leg), in various implementations the distribution of microterrain patterns (and, in fact, microposition patterns) on the garment may be substantially random, in which the distribution of different patterns are randomly dispersed about the surface of the garment.

Figure 7:
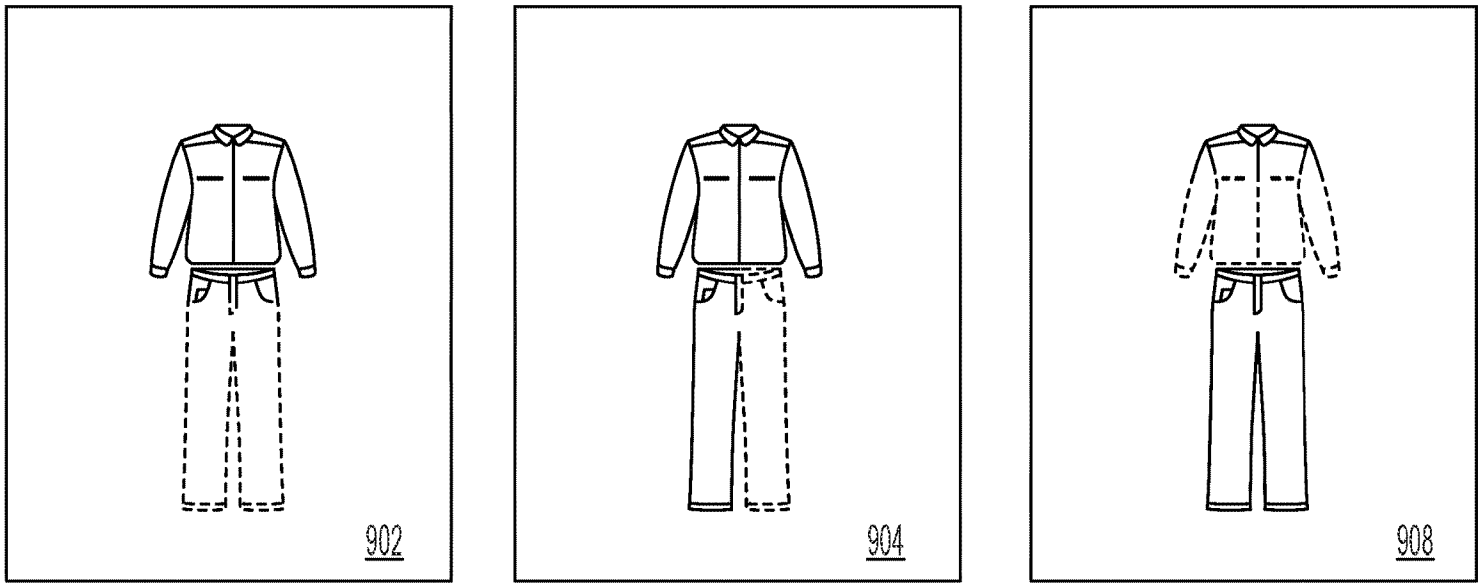
FIG. 7 is a series of drawings demonstrating the obscuring effect of Applicant's camouflage in a variety of scenarios.

Referring to FIG. 7, a series of images portraying example obscuring characteristics of various embodiments of Applicant's microterrain camouflage system is depicted. The embodiment depicted in FIG. 2 against a microterrain predominated by the vegetation depicted in image 104 is shown at 902. The majority of the lower portion of the legs is completely obscured. The embodiment depicted in FIG. 2 against a microterrain predominated by the vegetation depicted in image 108 is shown at 908. The majority of the mid-section is completely obscured.

The images 902, 904, and 908 demonstrate the ability of microterrain camouflage to obscure a portion of the wearer in a variety of microterrains of a larger target environment and, as a result, effectively obscure the human form from animals in the field.

Figure 8:
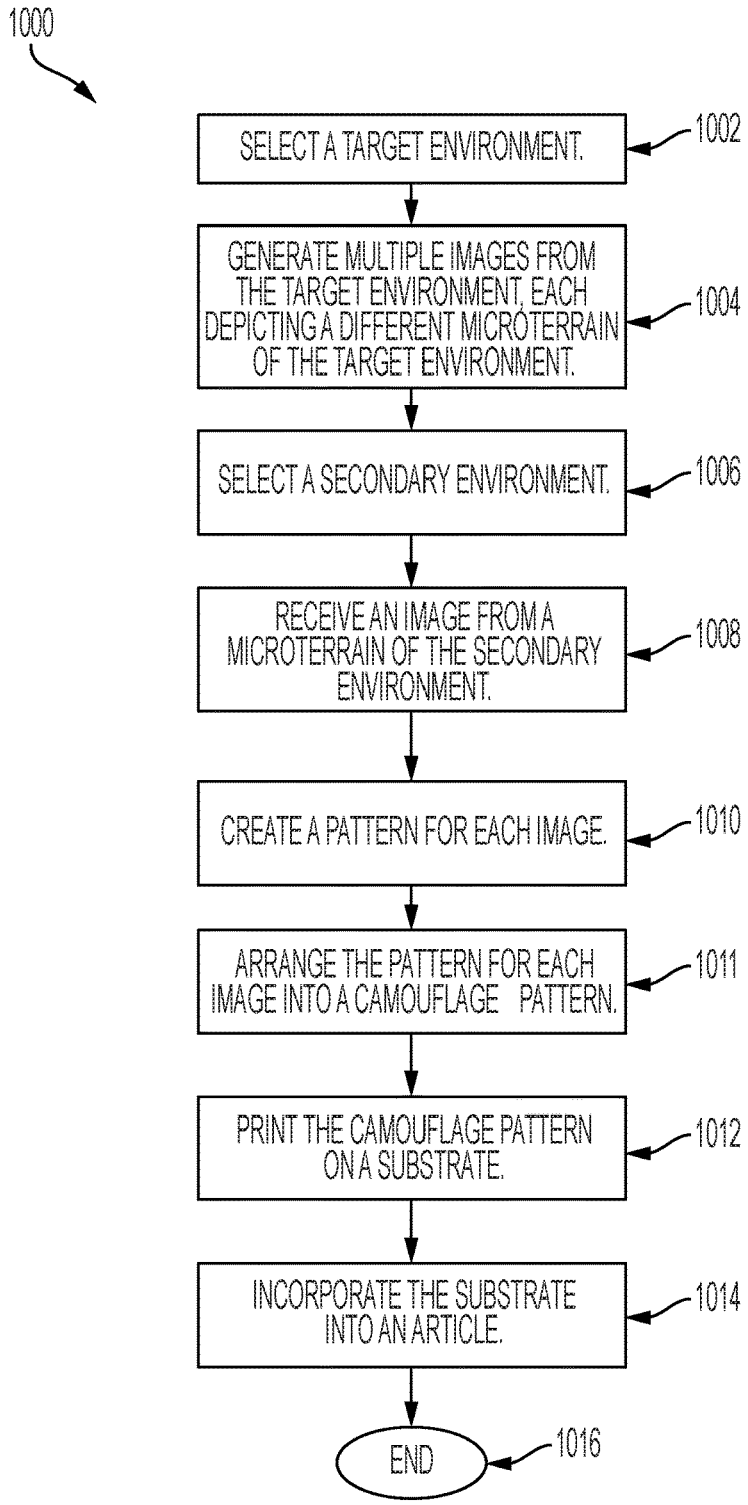
FIG. 8 is an exemplary method of making an article having a camouflage system.

Referring to FIG. 8, a flowchart 1000 of an exemplary method for making the present camouflage pattern is depicted. A target environment is selected at step 1002. In various embodiments, the target environment could be wetlands, woodlands, or western plains. In other implementations, though, the target environment may be an urban environment, indoor environment, sport environment (e.g., a paintball arena), and the like. Any environment may be selected in accordance with the present disclosure.

Multiple images or patterns, each depicting or representative of a microterrain within the target environment, are captured from the target environment at step 1004. In general, the multiple images or patterns will depict or represent prominent microterrains or micropositions within the larger, target environment. When the target environment is wetlands, for example, the microterrains may include those predominated by cattails and/or reeds nearby a lake, stream, or other body of water, grasses, and fencerows of vegetation. Alternatively, when the target environment is an urban environment, the microterrains may be predominated by portions of a building, elements of one or more cars, trucks, or other vehicles, elements from a city park or landscaping around a building, and the like. Generally, the microterrains represent common visual scenes likely to be found in a particular target environment. Depending upon the implementation, a single image or representation of the target environment may be captured or generated and then subdivided to generate the multiple images or patterns of step 1004. Alternatively, a plurality of separate images or patterns may be captured or generated to depict each of the target environment's microterrains.

In some cases, a secondary environment to the original target environment is also identified at step 1006. The secondary environment is generally different from the target environment. In various embodiments, the secondary embodiment can be wetlands, woodlands, western plains, or urban environments.

If a secondary environment is identified, an image, representation, or pattern is captured or generated from the secondary environment from a microterrain thereof at step 1008. Alternatively, multiple images or patterns may be captured or generated from the secondary environment, each depicting different microterrains or micropositions within a microterrain.

A pattern is created from each image or pattern of the target and secondary environments (if a secondary environment is utilized) at step 1010. Once the patterns for each image are created, the individual patterns are joined together to form a camouflage pattern in step 1011 that includes elements from each individual pattern. As such, the final camouflage pattern will include images, patterns, or representations of a number of different microterrains and/or different micropositions within one or more microterrains. The camouflage pattern is then printed on a substrate at step 1012. In one embodiment, the pattern is printed by screen printing, roller printing, air brushing, jet printing, or digital textile printing. In different embodiments, the substrate is the material used to form a garment, attached to the material used to form a garment, is applied to other objects, such as weapons, tents, backpacks, binoculars, or other outdoor equipment, or is attached to the surface of a hunting accessory.

The substrate is incorporated into an article at step 1014. In various embodiments, the substrate is incorporated into a garment, tent, hunting accessory, vehicle, structure, building, or any other item to be obscured. The method ends at step 1016.

In certain embodiments, when constructing a camouflage garment, the garment is cut from a single length of fabric, where the fabric comprises at least 3 distinct zones depicting microterrains of a particular target environment or different micropositions within one or more microterrains. Each zone can be an image or other representation of elements found in a particular microterrain within the target environment. A microterrain type may be, without limitation, a common type of scene identified within a larger environment, such as a sage scene, a grass scene, a leaf scene, a woodlands scene, a brush scene, a rock scene, a pine scene, a marsh scene, or a desert scene. The visual attributes of a particular microterrain of a target environment may also be affected by a season in which the microterrain may be depicted or the micropositions within the microterrain. For example, a "fall season" woodlands microterrain depiction may contain leaves, for example, having brown, orange, red and other fall colors; a "winter season" woodlands microterrain depiction may contain, for example, bare trees with no leaves and white snow; and a "summer season" woodlands microterrain depiction may contain, for example, green leaves with little or no twigs or bark. Similarly, different micropositions within a microterrain may have different visual attributes.

Figure 9B:
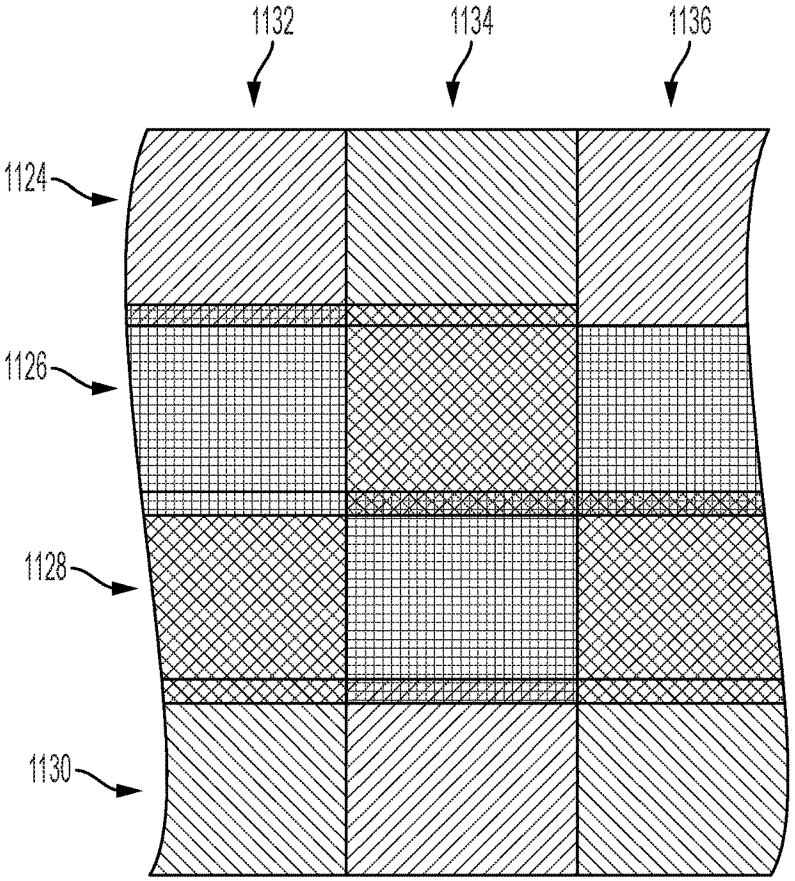
FIGS. 9A and 9B are representations of exemplary embodiments of a section of camouflage material used to create Applicant's camouflage garment.
Figure 9A:
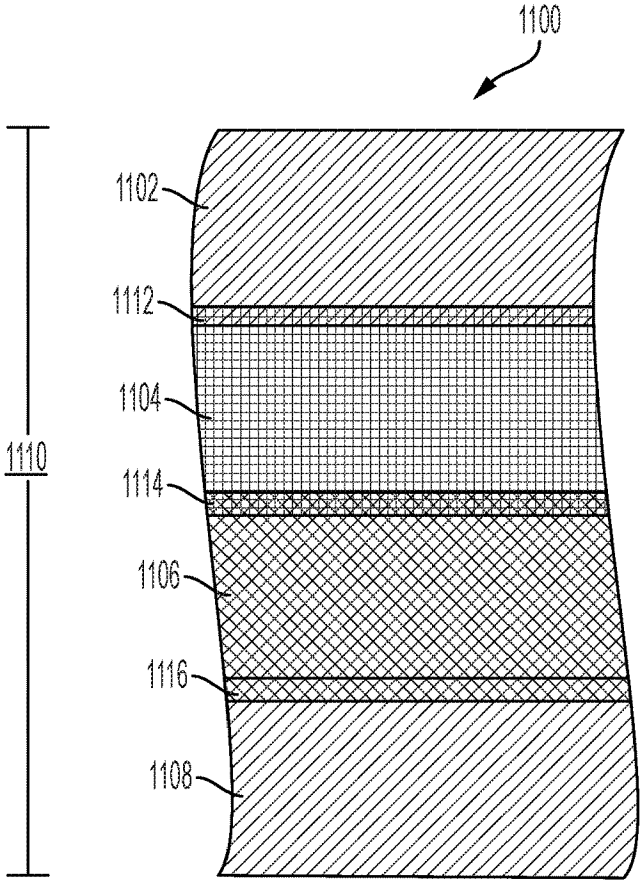

Referring to FIG. 9A, a representation of an exemplary embodiment of a section 1100 of camouflage material used to create Applicant's camouflage garment is presented. In different embodiments, the width 1110 of the section 1100 is between 24 and 80 inches. In one embodiment, the width 1110 of the section 1100 is 60 inches.

In the depicted embodiment, the section 1100 includes 4 distinct patterns or zones (1102, 1104, 1106, 1108) that run along the section 1100. In other embodiments, the section 1100 contains 3 to 6 patterns or zones depicting different microterrains that run along the section 1100. In one embodiment, the patterns are equal widths. In other embodiments, the width of one terrain pattern is greater than the width of another terrain pattern.

In one embodiment, each pattern depicts a different microterrain of a larger, target environment. For example, terrain pattern 1102 may be an image of a first microterrain predominated by a first type of vegetation, terrain pattern 1104 may be an image of a second microterrain predominated by a second type of vegetation, terrain pattern 1106 may be an image of a third microterrain predominated by a third type of vegetation, and terrain pattern 1108 may be an image of a fourth microterrain predominated by a fourth type of vegetation. In other embodiments, terrain pattern 1102, 1104, 1106 and 1108 may depict any combination of microterrain from a particular target environment.

In one embodiment, each terrain pattern seamlessly transitions into the adjacent terrain pattern. For example, terrain pattern 1102 seamlessly transitions into terrain pattern 1104 at transition region 1112, terrain pattern 1104 seamlessly transitions into terrain pattern 1106 at transition region 1114, terrain pattern 1106 transitions into terrain pattern 1108 at transition region 1116. For purposes of clarity, a seamless transition means that one terrain pattern transitions, or blends, into the next without a discernible break, line or seam. In other words, if terrain pattern 1102 depicts a sage microterrain and terrain pattern 1104 depicts a grass microterrain, transition region 1112 will contain both sage elements and grass elements. The portion of the transition region 1112 adjacent to the terrain pattern 1102 will contain primarily sage elements and the portion of the transition region 1112 adjacent to the terrain pattern 1104 will contain primarily grass elements. The center of the transition region 1112 will contain an equal mix of sage and grass elements. In this way, the smooth transition between terrain pattern 1102 and terrain pattern 1104 across transition region 1112 seamlessly blends the two terrain patterns together.

In various embodiments, the transition region is between about 2 inches and about 18 inches. In one embodiment, the transition region is about 8 inches. In one embodiment, the transition region is about 6 inches. In one embodiment, the transition region is about 4 inches.

In one embodiment, the image is seamless along the entire physical length of the fabric, of which section 1100 is a portion. In other words, the pattern continues along the entire physical length of the fabric without a discernible break, line or seam. In one embodiment, the pattern repeats along the length of the fabric. The pattern seamlessly transitions between each repeat segment.

In other implementations, however, transition between patterns (e.g., terrain patterns 1102, 1104, 1106, and 1108) are abrupt with no transition region present between the patterns.

The section 1100 may be created by screen printing, roller printing, air brushing, jet printing, digital printing, any other fabric printing technologies, or a combination thereof.

FIG. 9B depicts an alternate embodiment of a section of camouflage material. In FIG. 9B the fabric is printed with microterrain patterns that make up different blocks. The particular microterrain pattern occupying each block is varied between rows in the material (e.g., between sections or rows 1124, 1126, 1128, and 1130). Similarly, the particular microterrain pattern occupying each block can be varied between columns in the material (e.g., between sections or columns 1132, 1134, and 1136). Each block may be separated along any edge from other blocks of microterrain pattern using the optional transition regions as described above with reference to FIG. 9A. The fabric depicted in FIG. 9B may be fabricated, for example, using block printing or any other suitable printing technology.

Figure 10:
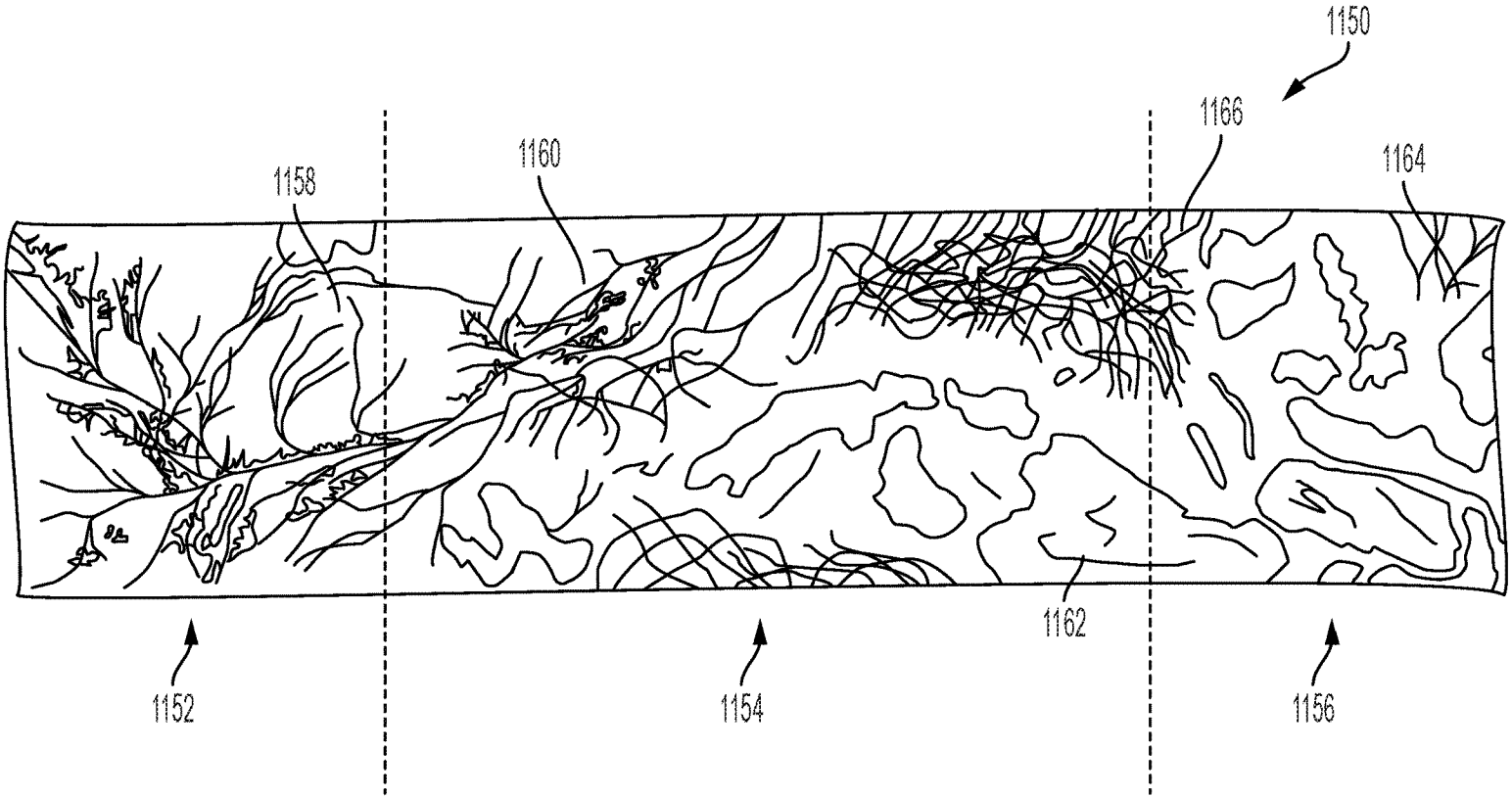
FIG. 10 is an illustration of an exemplary camouflage pattern configured in accordance with the present disclosure.

In another implementation, each microterrain pattern includes elements from the other microterrains being depicted in the camouflage patterns. FIG. 10, for example, depicts an example camouflage pattern 1150. The pattern 1150 generally includes three zones 1152, 1154, and 1156. Zone 1152 depicts primarily vegetation predominating in a first microterrain containing sage brush. Zone 1154 depicts primarily vegetation predominating in a first microterrain containing long grasses. Finally, zone 1156 depicts primarily vegetation predominating in a first microterrain containing foliage. Accordingly, camouflage pattern 1150 may be suitable for hunting in a high desert environment, where a hunter is likely to pass through microterrains containing sage brush, long grasses, and foliage. In various other implementations, however, zones 1152, 1154, and 1156 could depict different micropositions within the same microterrain, or a number of different micropositions within a number of different microterrains.

As depicted in FIG. 10, each zone of the camouflage pattern, although depicting primarily that zone's microterrain, includes elements from the other microterrains. For example, zone 1152, which is associated with the sage brush microterrain, includes a relatively small number of long grass elements (see element 1158). Similarly, zone 1154, which is associated with the long grass microterrain, includes elements from the sage brush microterrain (see element 1160), as well as the foliage microterrain (see element 1162). Finally, zone 1156, which is associated with the foliage microterrain, includes elements from the sage brush microterrain (see element 1164), as well as the long grass microterrain (see element 1166).

In one implementation, the depicted elements in each zone (e.g., zones 1152, 1154, and 1156) in camouflage pattern 1150 are selected to include 10% of the elements from the other microterrains in the camouflage pattern 1150 and the remaining elements from the target microterrain. Accordingly, in pattern 1150, zone 1152 will include 80% of its elements from the sage brush microterrain, 10% of its elements from the long grass microterrain, and 10% of its elements from the foliage microterrain. This approach ensures that each zone in a particular camouflage pattern is predominated by elements from a particular microterrain, but includes some elements from the other depicted microterrains.

In some cases, these percentages can be adjusted so that in a particular pattern, zones that are further away from one another include fewer elements from one another, whereas zones that are more proximate to one another may share a greater number of elements.

Figure 11:
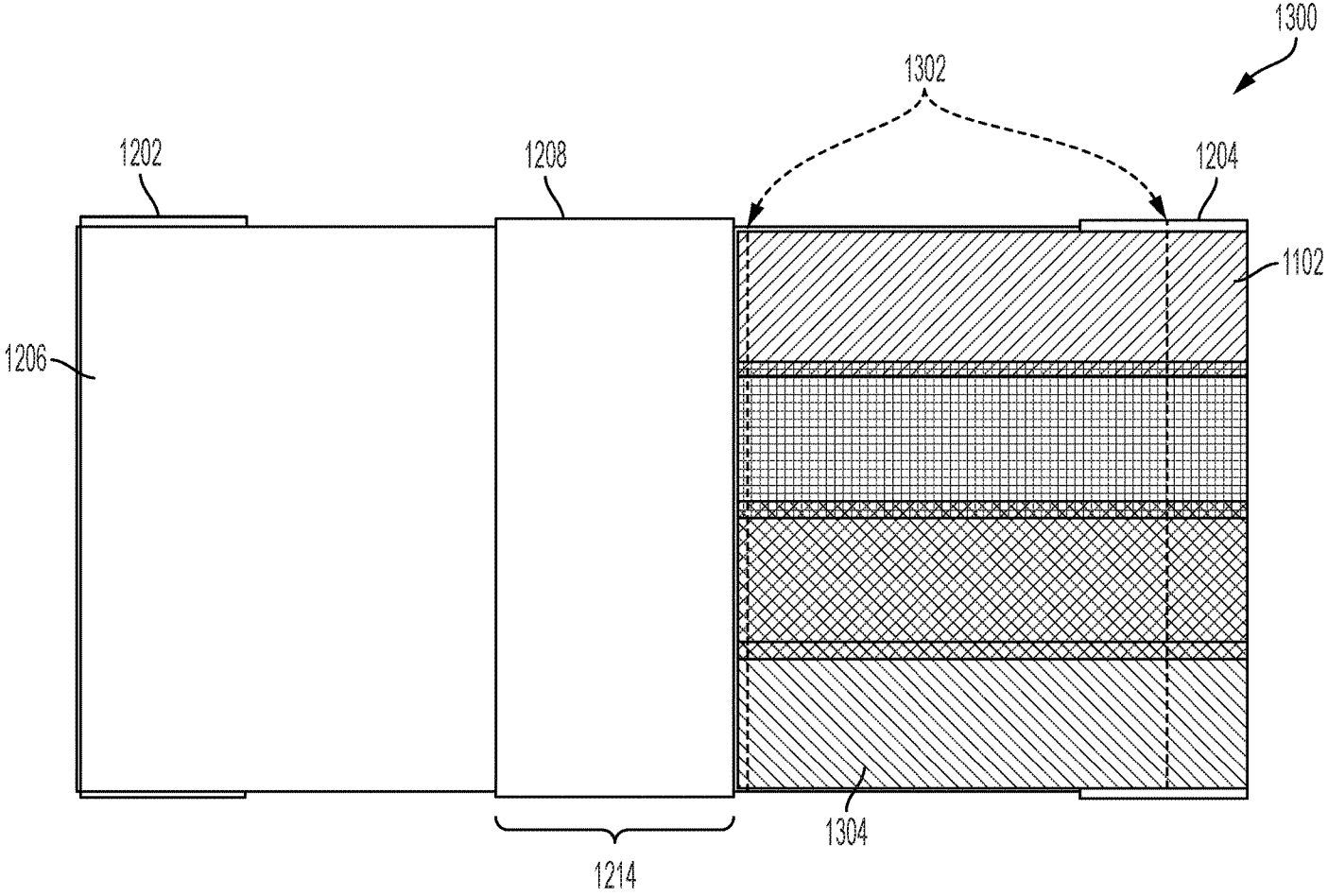
FIG. 11 is a top view of a roller printing apparatus.

Referring to FIG. 11, a top view of a roller printing apparatus that may be utilized in a roller printing apparatus for creating section 1100 is presented. The fabric 1206 is fed from the feed spool 1202, through print assembly 1214, and onto the processed spool 1204. The pattern 1304, in this example comprising 4 distinct microterrain patterns that seamlessly transition together, is applied to the fabric 1204 by the print assembly 1214. Dashed lines 1302 have been included to indicate the boundaries of a repeat pattern. As each repeat pattern seamlessly transition to the next repeat pattern, the boundary lines are not actually visible, but are shown here for clarity purposes only.

In various embodiments, multiple print assemblies 1214 are used to print an image on the fabric 1206. Each print assembly comprises a pressure roller, a print roller, and a reservoir. A print assembly may be provided for each color to be applied to the fabric. In some embodiments, between 2 to 6 print assemblies 1214 are used to apply the image to the fabric.

Figure 12:
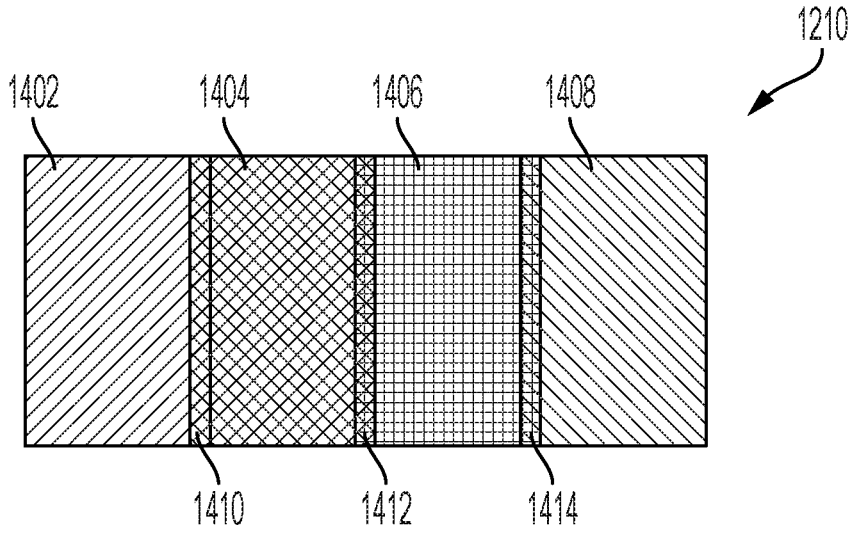
FIG. 12 is a top view of a print roller.

Referring to FIG. 12, a top view of a print roller 1210 is depicted. In the depicted embodiment, the print roller comprises 4 distinct patterns 1402, 1404, 1406, and 1408, each having a pattern recreating a microterrain of a particular target environment. In one embodiment, each of the 4 patterns are of different and distinct microterrains. In another embodiment, no adjacent microterrain patterns contain the same elements, but at least one microterrain appears in at least two microterrain patterns. Each microterrain pattern seamlessly transitions to the next in transition regions 1410, 1412, and 1414. Print roller 1210 may, in one example, have a circumference of about 25¼ inches and a diameter of about 8 1/32 inches. In another embodiment, print roller 1210 has a diameter between about 4 and 18 inches. In one embodiment, the surface of the print roller 1210 is copper engraved with the camouflage pattern In one embodiment, the surface of the print roller 1210 comprises copper etched with the patterns to be printed. In one embodiment, the diameter of the print roller is between 4 and 18 inches. In one embodiment, the diameter of the print roller is about 8 1/32 inches.

Figure 13:
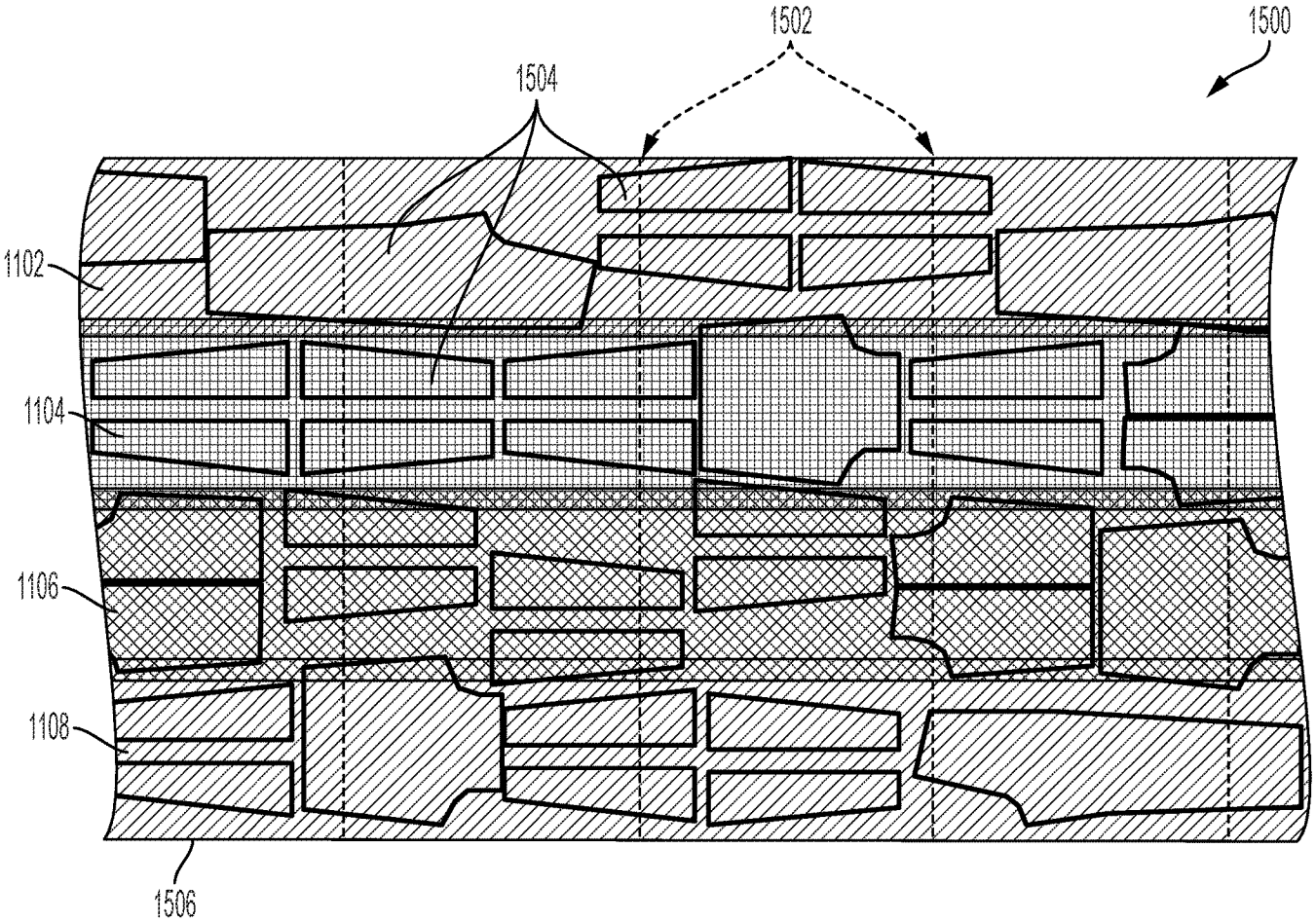
FIG. 13 is an exemplary pattern for the various segments of a garment cut from the printed fabric.

Garment segments are cut from the fabric after the terrain patterns have been applied to the fabric. Referring to FIG. 13, an exemplary pattern 1500 for the various segments 1504 of a garment cut from the printed fabric is depicted. Dashed lines 1502 have been included to indicate the boundaries of a repeat pattern. As each repeat pattern seamlessly transition to the next repeat pattern, the boundary lines are not actually visible, but are shown here for clarity purposes only. In this embodiment, each garment segment type (legs, left arm, right arm, body) are cut from random locations of pattern 1500 ensuring that on any particular garment, the microterrain patterns depicted by a particular region of the garment can be randomized. As illustrated, the legs, the left arm front and back, the body front and back, and the right arm front and back are each cut from randomized locations in pattern 1500 and so may contain any combination of patterns 1102, 1104, 1106, and/or 1108.

As the various garment segments are cut from the fabric 1506, the segments are cut from different offsets of the repeat pattern. For example, for the legs sections cut from terrain pattern 1102, the offset on the repeat pattern results in a different pattern on each segment depicted in FIG. 13. As such, depending on how the pattern is configured, it will be very unlikely for any two given pant legs to have the same pattern. In one implementation, the segments are cut from the pattern at random, ensuring that the various segments are different.

Figure 14:
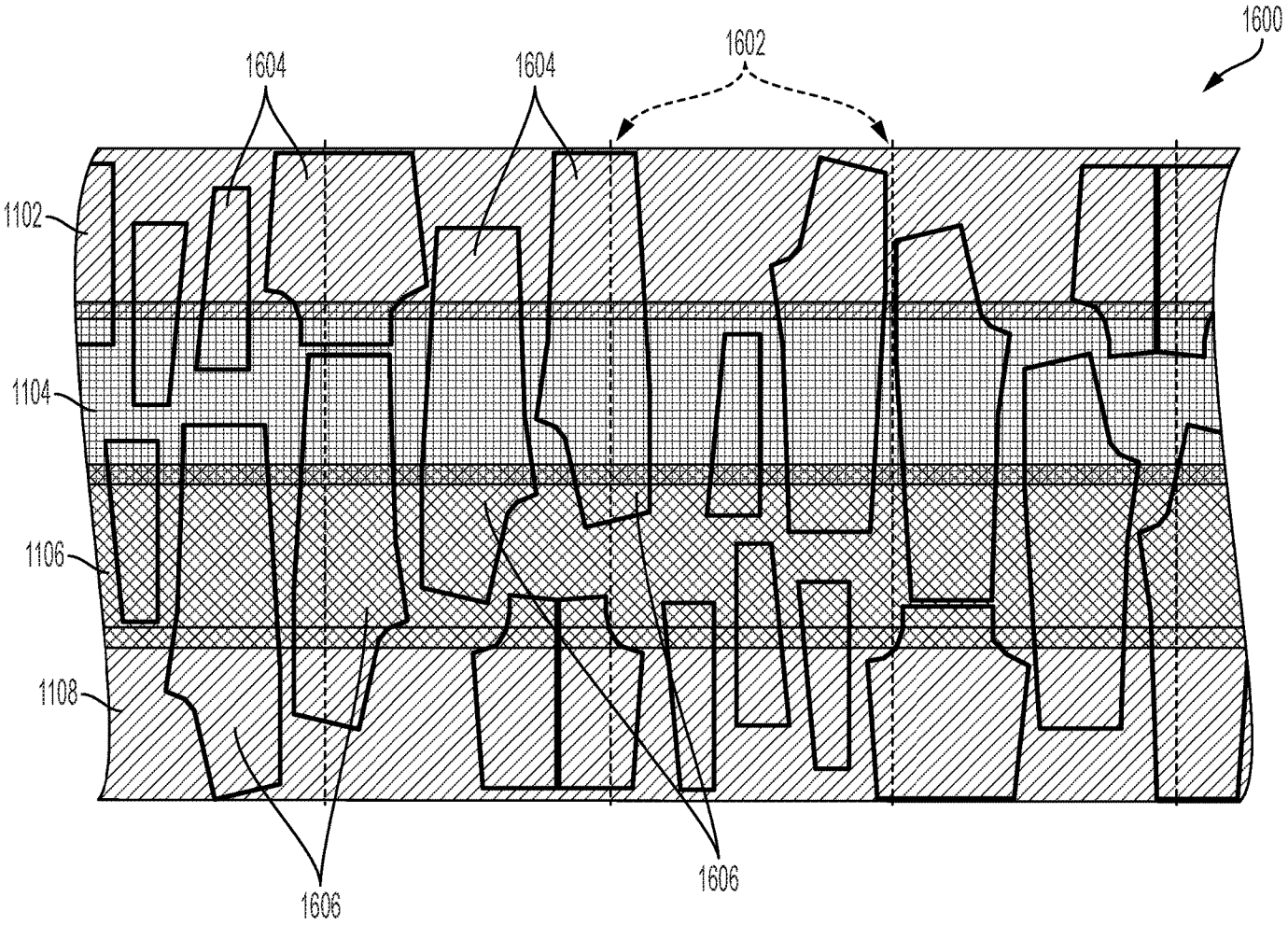
FIG. 14 is another exemplary pattern for the various segments of a garment cut from the printed fabric.

Referring to FIG. 14, another exemplary pattern 1600 for the various segments 1604 of a garment cut from the printed fabric is depicted. Dashed lines 1602 have been included to indicate the boundaries of a repeat pattern. As each repeat pattern seamlessly transitions to the next repeat pattern, the boundary lines are not actually visible, but are shown here for clarity purposes only.

In this embodiment, each garment segment type (legs, left arm, right arm, body) is each cut from at least two terrain patterns. For example, the pant legs 1604 are cut from various locations that cover, in different instances, all four terrain patterns. In this embodiment, at least 3 terrain patterns will be included in each pant leg 1606. The location of each segment 1604 is shifted to cover different microterrain patterns. The combination of the four microterrain patterns, 1102, 1104, 1106, and 1108, with the repeat pattern results in garment segments that comprise a combination of microterrain patterns and with a highly unique pattern.

In other implementations, the location and orientation of each segment or portion of a clothing item that may be cut from the fabric may be randomized or varied according to a suitable positioning algorithm. The randomization (or positioning algorithm) can be selected to ensure that each portion of a particular clothing garment (e.g., pant leg 1606, arm, chest, or collar) includes a varying amount of one or more of the available microterrains on the fabric. As such, each portion of a garment (e.g., the legs, arms, chest, or collar) can include not only a different number of microterrain patterns (e.g., one or more), but also a varying amount of each microterrain pattern. A similar variation in pattern could be achieved, for example, by cutting the portions of the garment from an underlying camouflage pattern wherein the pattern depicted thereon is at least somewhat randomized (see, for example, the pattern depicted in FIG. 9B). In some cases, a combination of these techniques may be used to provide that each portion of the garment includes a varying amount of depiction of one or more of the available microterrains on the source camouflage fabric.

Figure 15:
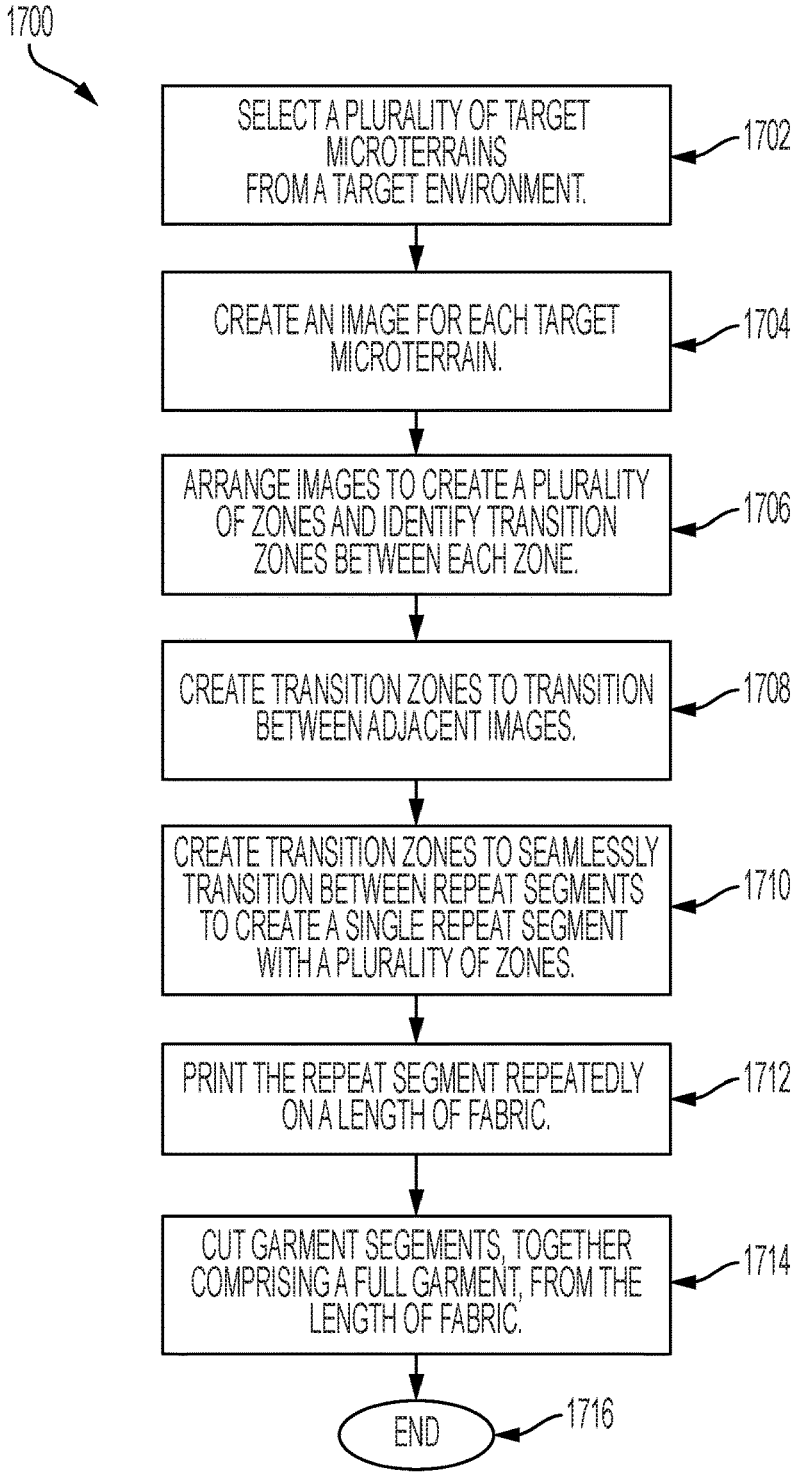
FIG. 15 is a flowchart of a method to create a camouflage garment having a plurality of terrains.

Referring to FIG. 15, a flowchart 1700 of a method to create a camouflage garment having a plurality of patterns is presented. A plurality of target microterrains within a particular target environment are selected at step 1702. An image or representation of each target microterrain is created at step 1704. The images are arranged side-by-side to create a section of a multi-microterrain image to be printed across the width of a length of fabric at step 1706. The arrangement of the images will define the transition regions. Once the desired width of the transition regions are determined, transition regions are created to seamlessly blend adjacent images at step 1708. In some cases, the depiction of each microterrain includes a relatively small number (e.g., 10%) of elements selected from the other microterrains of the camouflage pattern. This minimizes the degree to which portions of the pattern depicting a particular microterrain stand out when located in a different microterrain of the particular target environment.

Additional transition regions at the ends of each repeat section are created at step 1710 if desired. These transition regions seamlessly blend the end of one repeat segment with the beginning of the next repeat segment if desired. The size of a repeat segment matches the size of the print roller used to apply the repeat segment to fabric, where the length of a repeat segment is equal to the circumference of the print roller and the width of the repeat segment is equal to the printable width of the roller. In one embodiment, the repeat segment is etched into the copper surface of the print roller. In other embodiments, the repeat segment is loaded into a computer-controlled print system of an ink jet fabric printing system.

The repeat segment is printed repeatedly and continuously onto a length of fabric at step 1712. Garment segments are cut out of the printed fabric at step 1714. In one embodiment, the garment segments cut from the fabric comprise a full garment such that the garment comprises a pattern corresponding to every microterrain of the plurality of microterrains originally selected. The method ends at step 1716.

The described features, structures, or characteristics of the invention may be combined in any suitable manner in one or more embodiments. In the above description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention. In other words, the present invention may be embodied in other specific forms without departing from its spirit or essential characteristics. The described implementations are to be considered in all respects only as illustrative and not restrictive. The scope of the invention should, therefore, be determined not with reference to the above description, but instead should be determined with reference to the pending claims along with their full scope or equivalents, and all changes which come within the meaning and range of equivalency of the claims are to be embraced within their full scope.

What is claimed is:

1. A camouflage system for use in a target environment, comprising:

a camouflage jacket having a body, a left arm, and a right arm, wherein the left arm of the camouflage jacket comprises a first pattern that depicts grasses in a first visual scene of the target environment and does not depict woodland in a second visual scene of the target environment, wherein the right arm of the camouflage jacket comprises a second pattern that depicts the grasses in the first visual scene of the target environment and does not depict the woodland in the second visual scene of the target environment, wherein the body of the camouflage jacket comprises a third pattern that depicts the woodland in the second visual scene of the target environment and does not depict the grasses in the first visual scene of the target environment, wherein, when the camouflage jacket is viewed in the first visual scene of the target environment, the left arm and the right arm of the camouflage jacket are obscured, and the body of the camouflage jacket is not obscured, wherein, when the camouflage jacket is viewed in the second visual scene of the target environment, the left arm and the right arm of the camouflage jacket are not obscured, and the body of the camouflage jacket is obscured, wherein at least a portion of the first pattern on the left arm of the camouflage jacket is the same as at least a portion of the second pattern on the right arm of the camouflage jacket, and wherein the third pattern on the body of the camouflage jacket does not match any portion of the first pattern on the left arm of the camouflage jacket or any portion of the second pattern on the right arm of the camouflage jacket.

2. The camouflage system of claim 1, further comprising a first transition region disposed between the first pattern and the second pattern, wherein the first transition region is configured to seamlessly transition between the first pattern and the second pattern.

3. The camouflage system of claim 2, further comprising a second transition region disposed between the second pattern and the third pattern, wherein the second transition region is configured to seamlessly transition between the first pattern and the second pattern.

4. A camouflage system for a target environment, comprising:

camouflage pants having a left leg and a right leg, wherein the right leg of the camouflage pants comprises a first pattern that depicts cattails or reeds in a first visual scene of the target environment and does not depict woodland vegetation in a second visual scene of the target environment, and wherein the left leg of the camouflage pants comprises a second pattern that depicts woodland vegetation in a second visual scene of the target environment and does not depict the cattails or reeds in the first visual scene of the target environment, wherein, when the camouflage pants are viewed in the first visual scene of the target environment, the right leg of the camouflage pants is obscured, and the left leg of the camouflage pants is not obscured, wherein, when the camouflage pants are viewed in the second visual scene of the target environment, the right leg of the camouflage pants is not obscured, and the left leg of the camouflage pants is obscured, and wherein the first pattern on the right leg of the camouflage pants does not match any portion of the second pattern on the left leg of the camouflage pants.

5. The camouflage system of claim 4, further comprising a first transition region disposed between the first pattern and the second pattern.

* * * * *